US005931009A

United States Patent [19]

Choi

[11] Patent Number: 5,931,009

[45] Date of Patent: Aug. 3, 1999

[54] DEFROSTING APPARATUS OF AIR CONDITIONER AND METHOD THEREOF

[75] Inventor: Kwi-Ju Choi, Kyungki-do, Rep. of Korea

[73] Assignee: Samsung Electronics Co., Ltd., Suwon, Rep. of Korea

[21] Appl. No.: 08/986,299

[22] Filed: Dec. 5, 1997

[30] Foreign Application Priority Data

Jun. 27, 1997 [KR] Rep. of Korea ..... 97-28367

[51] Int. Cl.[6] ..... F25D 21/06

[52] U.S. Cl. ..... 62/154; 62/155; 62/156

[58] Field of Search ..... 62/151, 155, 156, 62/234, 154

[56] References Cited

U.S. PATENT DOCUMENTS 5,257,506 11/1993 DeWolf et al. ..... 62/156 X 5,440,890 8/1995 Bahel et al. ..... 62/156 X

*Primary Examiner*—Harry B. Tanner

*Attorney, Agent, or Firm*—Burns, Doane, Swecker & Mathis, L.L.P.

[57] ABSTRACT

A defrosting apparatus of an air conditioner and method thereof are provided to efficiently carry out a defrosting operation during the heating operation by comparing temperature of an outdoor heat-exchanger, an outdoor temperature and an operation time of a compressor to correctly discriminate whether the frost has accumulated at an outdoor unit, to thereby effectively carry out defrosting operation, the air conditioner having an outdoor heat-exchanger to heat-exchange the outdoor air and a compressor to compress a coolant for being heat-exchanged at the heat-exchanger, the apparatus comprising: a pipe temperature detecting unit to detect the outdoor temperature; an outdoor temperature detecting unit to detect the outdoor temperature during the heating operation via the operation of the compressor; a controlling unit to control the defrosting operation by discriminating the accumulation of the frost on the outdoor unit with consideration of the temperature of the outdoor heat-exchanger, the outdoor temperature detected by the outdoor temperature detecting unit and the time when the compressor is operated; a four way valve to change the flow of the coolant for carrying out defrosting operation according to the control of the controlling unit; and a compressor driving unit to drive the compressor to carry out the defrosting operation according to the control of the controlling unit.

10 Claims, 8 Drawing Sheets

DEFROSTING APPARATUS OF AIR CONDITIONER AND METHOD THEREOF

BACKGROUND OF THE INVENTION

1. Field of the Invention

The present invention relates to an air conditioner with a dual function of the cooling and heating operations, and more particularly to a defrosting apparatus of an air conditioner and method thereof to correctly discriminate whether frost has accumulated at an outdoor unit.

2. Description of the Prior Art

A general air conditioner includes a heating apparatus for supplying warm air by heating cold room air and a cooling apparatus for supplying cool air by cooling warm room air. Besides, a heating or cooling apparatus is also marketed for a dual function of heating and cooling operations and for air purifying function which cleans the polluted room air.

FIGS. 1 and 2 illustrate an indoor unit of the heating or cooling apparatus (generally referred to as an air conditioner) among conventional air conditioners. As shown in FIG. 1, an suction grille member(5) is provided at a lower front surface of an indoor unit main body (hereinafter referred to as a main body) with a plurality of suction inlets(3) to suck room air and with a plurality of discharge outlets(7) at an upper front surface of the main body to discharge the heat-exchanged air, i.e., the heated or cooled air, that is sucked through the suction inlets(3).

Furthermore, the discharge outlets(7) comprises horizontal vanes(9) and vertical vanes(11) for controlling the vertical and horizontal directions of the air discharged indoors therethrough(7), a covering member(13) attached for forming an external appearance thereof and for protecting interior parts therein, and an operating part(15) disposed at a lower portion of the cover member(13) for controlling overall operational modes (automatic, cooling, dehumidifying, blow, heating, etc.) of the air conditioner, a start or stop operation thereof and the amount and direction of the air discharged through the discharge outlets(7).

As shown in FIG. 2, there are provided a filtering member (17) disposed at an inner side of the suction grille member(5) for filtering dust and foreign objects floating with the room air sucked through the suction inlets(3) and an indoor heat-exchanger(19) disposed in the filtering member(17) for heat-exchanging heated air or cooled air through evaporative latent heat of a coolant.

In addition, the heat-exchanger(19) is disposed thereover with a blower fan(23) (hereinafter referred to as indoor fan) which rotates according to operation of an indoor fan motor in order to suck the room air through the suction inlets(3) and, at the same time, to discharge through the discharge outlets(7) the air heat-exchanged at the heat-exchanger(19). The indoor fan(23) is also provided with a duct member(25) at an external side thereof for covering the indoor fan(23) and for guiding the flow of the air sucked through the suction inlets(3) and discharged through the discharge outlets(7).

In an inverter air conditioner with a dual function of the heating and cooling operations, the four way valve(31) is turned on for the heating operation and thereby the coolant is circulated in the following sequence: compressor(39)—four way valve(31)—indoor heat-exchanger(19)—expansion valve(33)—heating expansion valve(34)—outdoor heat exchanger(35)—four way valve(31)—compressor(39), as shown in the dotted line in FIG. 3.

On the other hand, when the four way valve(31) is turned off for the cooling operation, the coolant circulates in the following sequence: compressor(39)—four way valve (31)—outdoor heat-exchanger(35)—one way valve(36)—expansion valve(33)—indoor heat-exchanger(19)—four way valve(31)—compressor(39) as shown in the straight line in FIG. 3. At this time, the four way valve(31) controls the circulation route of the coolant in the straight line or in the dotted line respectively when the four way valve(31) is turned off or on.

In the inverter air conditioner with a dual function of the cooling and heating operations, an user turns on a start/stop key (hereinafter referred to as an operation key) with a remotely controlled unit or with the operating part(15) and selects a desired operation mode (for instance, heating). When the set temperature(Ts) is higher than the room temperature (Tr), an operation frequency of the compressor (39) is determined according to a temperature difference between Ts and Tr to drive the compressor(39).

When the compressor(39) is driven, the coolant is circulated in the following sequence, as shown in the dotted line in FIG. 3: compressor(39)—four way valve(31)—indoor heat-exchanger(19)—expansion valve(33)—heating expansion valve(34)—outdoor heat-exchanger(35)—four way valve(31)—compressor (39), thereby heating the indoor heat-exchanger(19). Operation of the indoor fan(23) is controlled according to the temperature of the indoor heat-exchanger(19).

If the temperature of the indoor heat-exchanger(19) is lower than the predetermined temperature (about 27° C.), the indoor fan(23) is stopped to prevent cool air from being discharged indoors at the initial heating stage. If the temperature of the indoor heat-exchanger(19) is higher than the predetermined temperature (about 27° C.), the indoor fan (23) is operated.

If the indoor fan(23) is rendered operative, the dust and foreign objects floating in the room air sucked through the suction inlets(3) into the main body(1) are removed by the filtering member(17). The purified room air is heat-exchanged into warn air by way of evaporative latent heat of the coolant at the indoor heat-exchanger(19).

The warm air heat-exchanged at the indoor heat exchanger(19) is guided upwards and discharged indoors through the discharge outlets(7). The warm air discharged through the discharge outlets(7) carries out the heating operation at air directions according to the angles of the vanes(9) and (11).

If the heating operation is carried out for a certain period of time and the air blown from outside is heat-exchanged and cooled by evaporative latent heat at the outdoor heat-exchanger(35), frost can be accumulated at the outdoor heat-exchanger by the cool air being discharged outside. Therefore, there is a problem in that the accumulated frost turns into thick ice, thereby deteriorating the operation efficiency of the outdoor heat-exchanger(35) and increasing energy consumption. In addition, there is another problem in that the frost accumulated on the outdoor heat-exchanger (35) causes ice formation phenomenon, resulting in an operation defect at the compressor(39).

As for these problems, the conventional air conditioner includes a pipe temperature sensor (not shown) which detects the temperature of the outdoor heat-exchanger(35) from 30 minutes after the compressor(39) has started being operated during the heating operation, to thereby measure the temperature changing speed of the outdoor pipe temperature. If the temperature changing speed of the outdoor pipe temperature is over the predetermined speed, it is regarded as a frosting condition where the frost has accumulated. Therefore, an outdoor fan(37) and an indoor fan (23) are stopped to cease the heating operation, and the four way valve(31) is turned off to convert the operation of the air conditioner into the cooling operation.

Accordingly, the coolant is circulated in the following sequence for the cooling operation: compressor(39)—four way valve(31)—outdoor heat-exchanger(35)—one way valve(36)—expansion valve(33)—indoor heat-exchanger (19)—four way valve(31)—compressor(39), to thereby start heating the outdoor heat-exchanger(35) for removing the frost accumulated on the outdoor heat-exchanger(35).

However, there are problems in the conventional defrosting method of the air conditioner in that a rapid measurement of the temperature changing speed at the outdoor heat-exchanger(35) and a high precision of the pipe temperature sensor (not shown) are necessary to detect a frosting condition, thereby increasing the cost of the high precision product and bringing about inaccurate detection about the accumulated frost on the outdoor unit as the temperature of the outdoor heat-exchanger(35) is detected.

SUMMARY OF THE INVENTION

The present invention is presented to solve the aforementioned problems and it is an object of the present invention to provide a defrosting apparatus and method thereof in the air conditioner by comparing temperature of an outdoor heat-exchanger, outdoor temperature and operation time of a compressor and carrying out the defrosting operation only when frost has accumulated at an outdoor unit, to thereby improve the efficiency of the heating operation.

In order to achieve the object of the present invention, there is provided a defrosting apparatus of an air conditioner which includes an outdoor heat-exchanger to heat-exchange outdoor air and a compressor to compress a coolant for heat-exchanging at the heat-exchanger, the apparatus comprising:

pipe temperature detecting means to detect the outdoor temperature;

outdoor temperature detecting means to detect the outdoor temperature during the heating operation via the operation of the compressor;

controlling means to control the defrosting operation by discriminating the accumulation of the frost on the outdoor unit with consideration of the temperature of the outdoor heat-exchanger, the outdoor temperature detected by the outdoor temperature detecting means and the time when the compressor is in operation;

a four way valve to change the flow of the coolant for carrying out the defrosting operation according to the control of the controlling means; and compressor driving means to drive the compressor to carry out the defrosting operation according to the control of the controlling means.

The method of the defrosting apparatus of the air conditioner in accordance with the present invention comprises the steps of:

carrying out the heating operation by discharging out the warm air heat-exchanged by way of the operation of the compressor and the indoor heat-exchanger;

detecting the temperature of the outdoor heat-exchanger at the heating step of the heating operation;

detecting the outdoor temperature at the heating step of the heating operation;

counting the time when the compressor is rendered operative at the heating step of the heating operation;

removing the frost accumulated on the outdoor unit by driving the four way valve and the compressor if the temperature of the outdoor heat-exchanger is under the predetermined temperature for the predetermined period of time in comparison with the outdoor temperature and if the time when the compressor has been operated is over the predetermined period of time; and stopping the defrosting operation to proceed to the heating operation if the temperature of the outdoor heat-exchanger is over the predetermined temperature and the defrosting operation is carried out over the predetermined period of time.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE INVENTION

Figure 1:
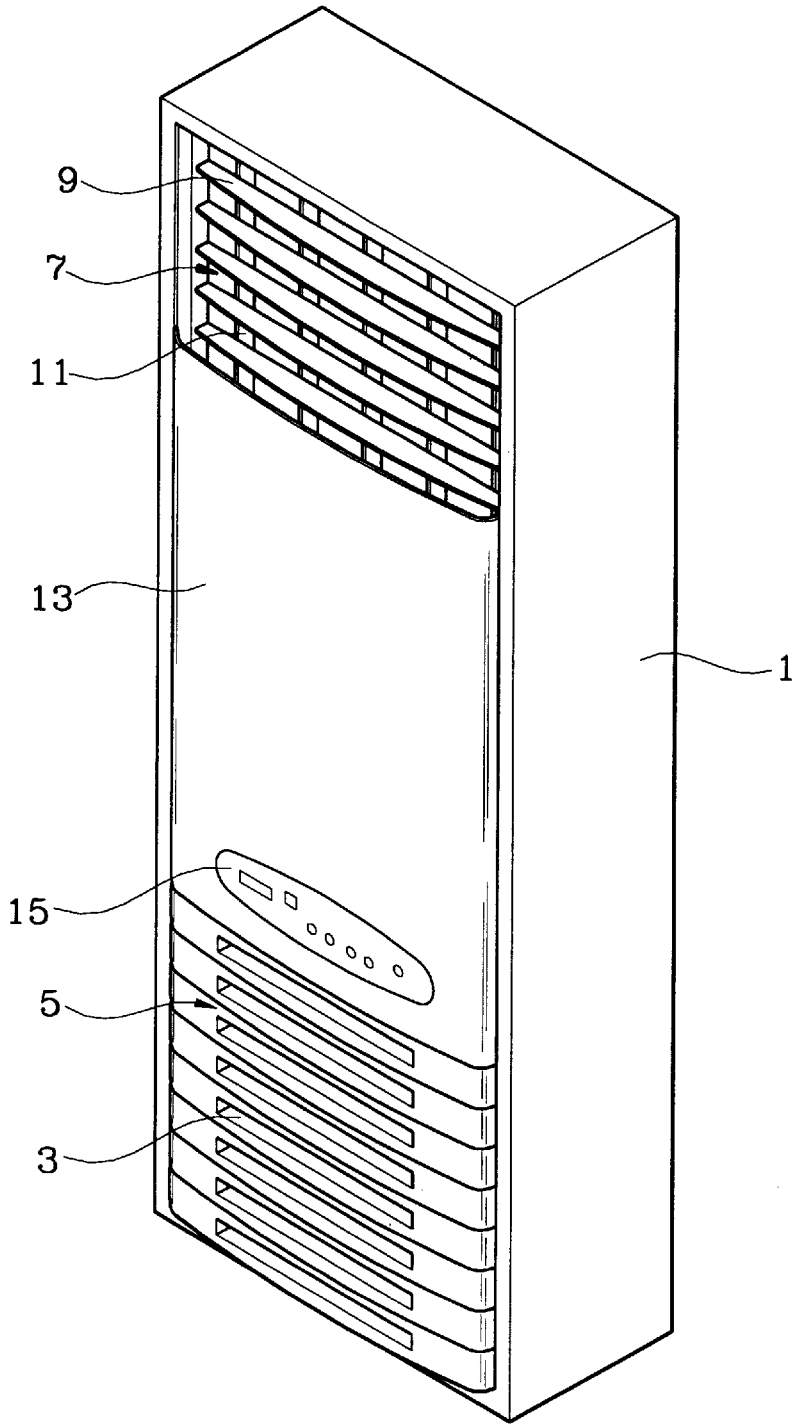
FIG. 1 is a perspective view for illustrating an indoor unit of a conventional air conditioner.
Figure 2:
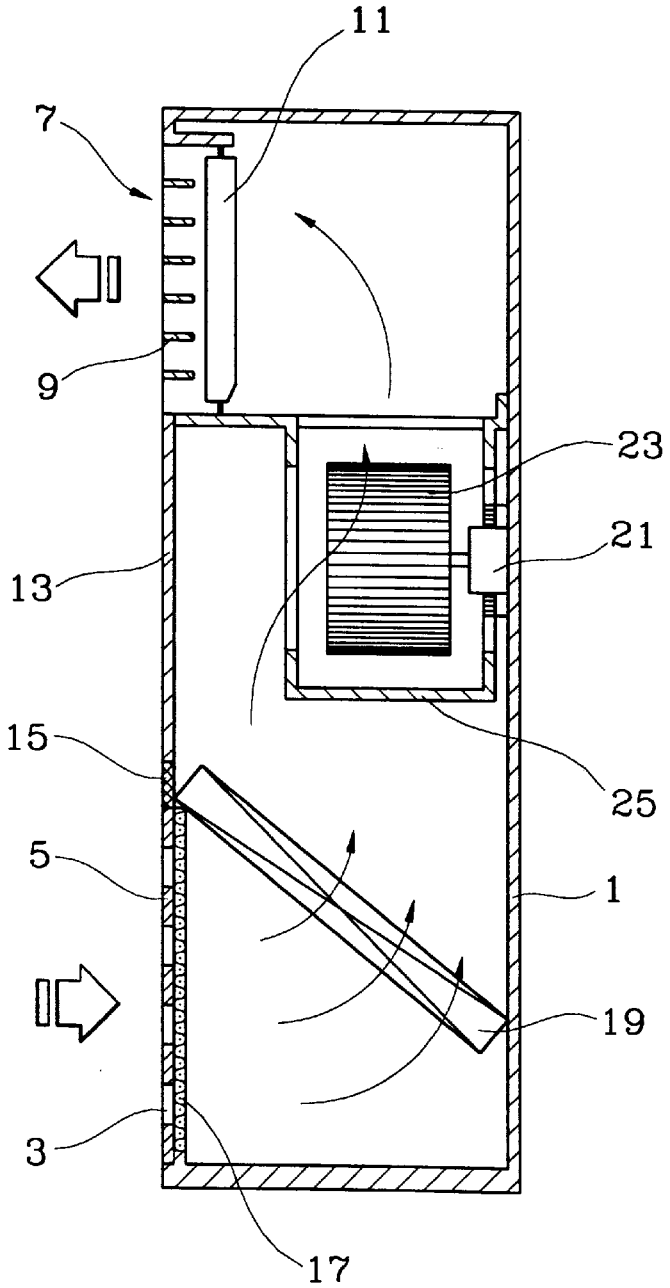
FIG. 2 is a longitudinal sectional view of FIG. 1.

The present invention is described in detail with reference to the accompanying drawings. Throughout the drawings, like reference numerals and symbols in FIGS. 1 and 2 are used for designation of like or equivalent parts or portions for simplicity of illustration and explanation, and redundant references will be omitted.

Figure 4:
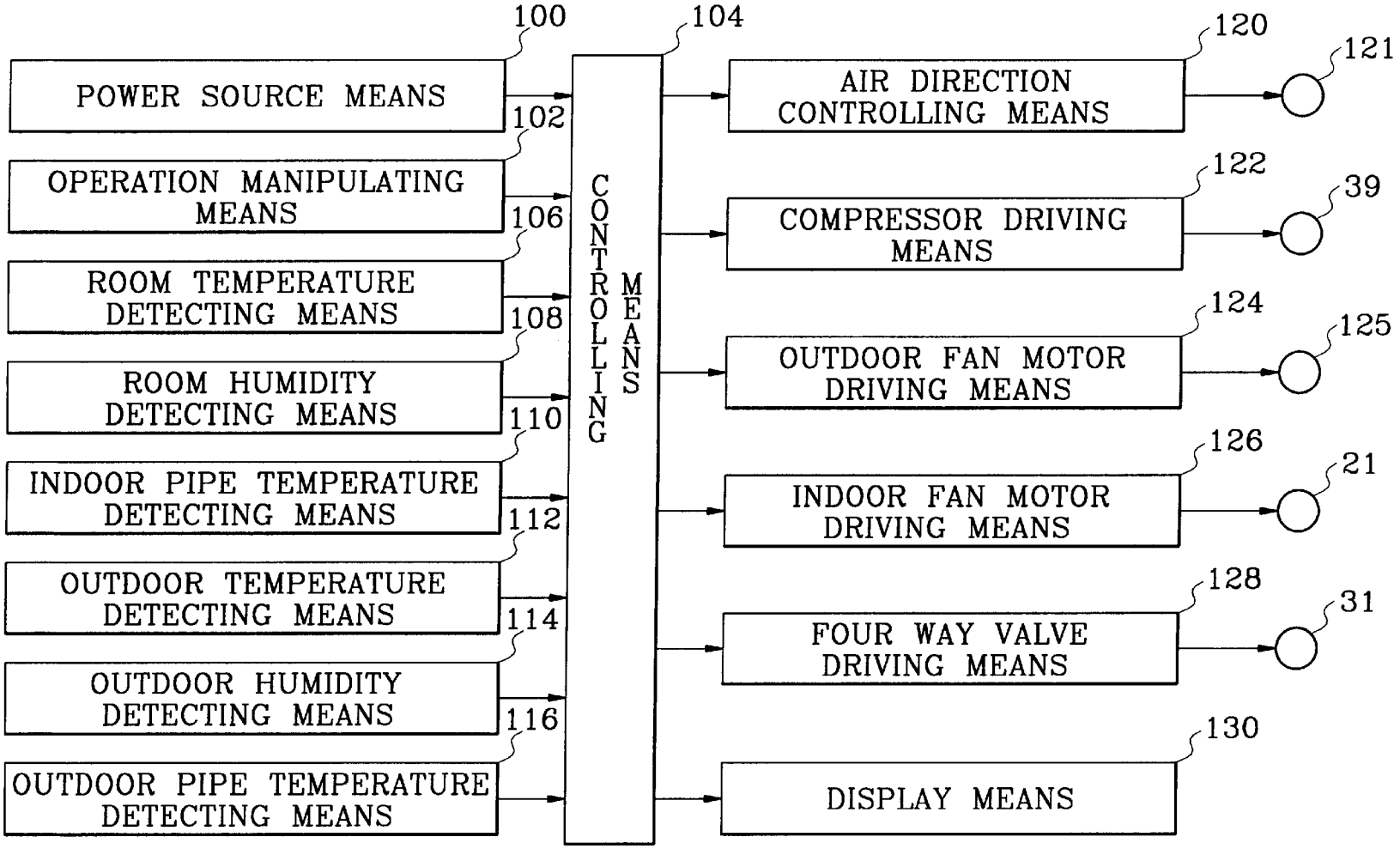
FIG. 4 is a schematic block diagram for illustrating a defrosting apparatus in accordance with an embodiment of the present invention.

As shown in FIG. 4, power source means(100) is provided to transform commercial alternating current voltage supplied from the alternating current power terminal (not shown) into the predetermined direct current voltage. Operation manipulating means(102) comprises a plurality of selection keys for all operation modes (auto, cooling dehumidifying, blowing, heating and the like), for an amount (strong air, weak air, or soft air) of air discharged through the discharge outlets(7), for temperature (Ts) to be set as desired, and an operation key to start or stop the air conditioner.

Besides, controlling means(104) is a microcomputer to control overall operations of the air conditioner according to the operation selection signals from the operation manipulating means(102) and to control the defrosting operation by detecting frost accumulated on the outdoor unit according to the temperature of the outdoor heat-exchanger(35), the outdoor temperature and the operation time of the compressor. The controlling means includes an outdoor unit microcomputer disposed at the outdoor unit to control the operation of the compressor(39), the outdoor fan(37) and the four way valve(31), and a communication cable connecting between the outdoor and indoor units to input and output each other the communication signals coded for the outdoor and indoor computers.

Room temperature detecting means(106) detects the temperature (Tr) of the room air sucked through the suction inlets(3) to adjust the room temperature to the temperature (Ts) a user sets with the operation manipulating means(102) by carrying out the heating operation of the air conditioner. Indoor humidity detecting means(108) detects the humidity (Hr) of the room air sucked through the suction inlets. Indoor pipe temperature detecting means(110) detects the temperature of the indoor heat-exchanger pipe which changes during the heating operation of the air conditioner, that is, the temperature of the coolant passing at the indoor heat-exchanger(19).

During the heating operation, outdoor temperature detecting means(112) detects the changing temperature (To) of the outdoor air and outdoor humidity detecting means(114) detects the changing humidity (Ho) of the outdoor air. Outdoor pipe temperature detecting means(116) detects the pipe temperature of the outdoor heat-exchanger(35) which changes during the heating operation of the air conditioner, that is, the temperature of the coolant passing through the outdoor heat-exchanger(35), to output to the controlling means(104).

Air direction controlling means(120) controls an air direction motor(121) to get the air discharged through the discharged outlets(7) into the predetermined horizontal and vertical directions evenly all over the room while compressor driving means(122) controls operation of the compressor (39) by way of the control signal generated from the controlling means(104) according to a temperature difference between the temperature (Ts) the user preset with an operation manipulating means(102) and the temperature (Tr) detected by the room temperature detecting means(106).

Outdoor fan motor driving means(124) controls an outdoor fan(37) by controlling the rotation number of the outdoor fan motor(125) to blow outdoors the air heat-exchanged at the outdoor heat-exchanger(35) by way of the control signal generated from the control means(104) according to the temperature difference between the temperature (Ts) preset by the user and the temperature (Tr) detected by the room temperature detecting means(106).

Indoor fan motor driving means(126) controls the indoor fan (23) by controlling the rotation number of the indoor fan motor(21) to blow indoors the air heat-exchanged at the indoor heat-exchanger(19) by way of the control signal generated from the controlling means(104) according to the air amount preset by the user with the operation manipulating means(102).

As shown in the drawings, four way valve driving means (128) controls an on/off operation of the four way valve(31) to change the flow of the coolant according to the operation condition (cooling or heating) input by the operation manipulating means(102) by way of the control signal generated from the control means(104). Display means(130) displays the operation mode (auto, cooling, dehumidifying, blowing, heating and the like) selected by the operation manipulating means(102), and a dehumidifying lamp indicates the dehumidifying operation or dehumidifying completion and overall operation state of the air conditioner.

Figure 5A:
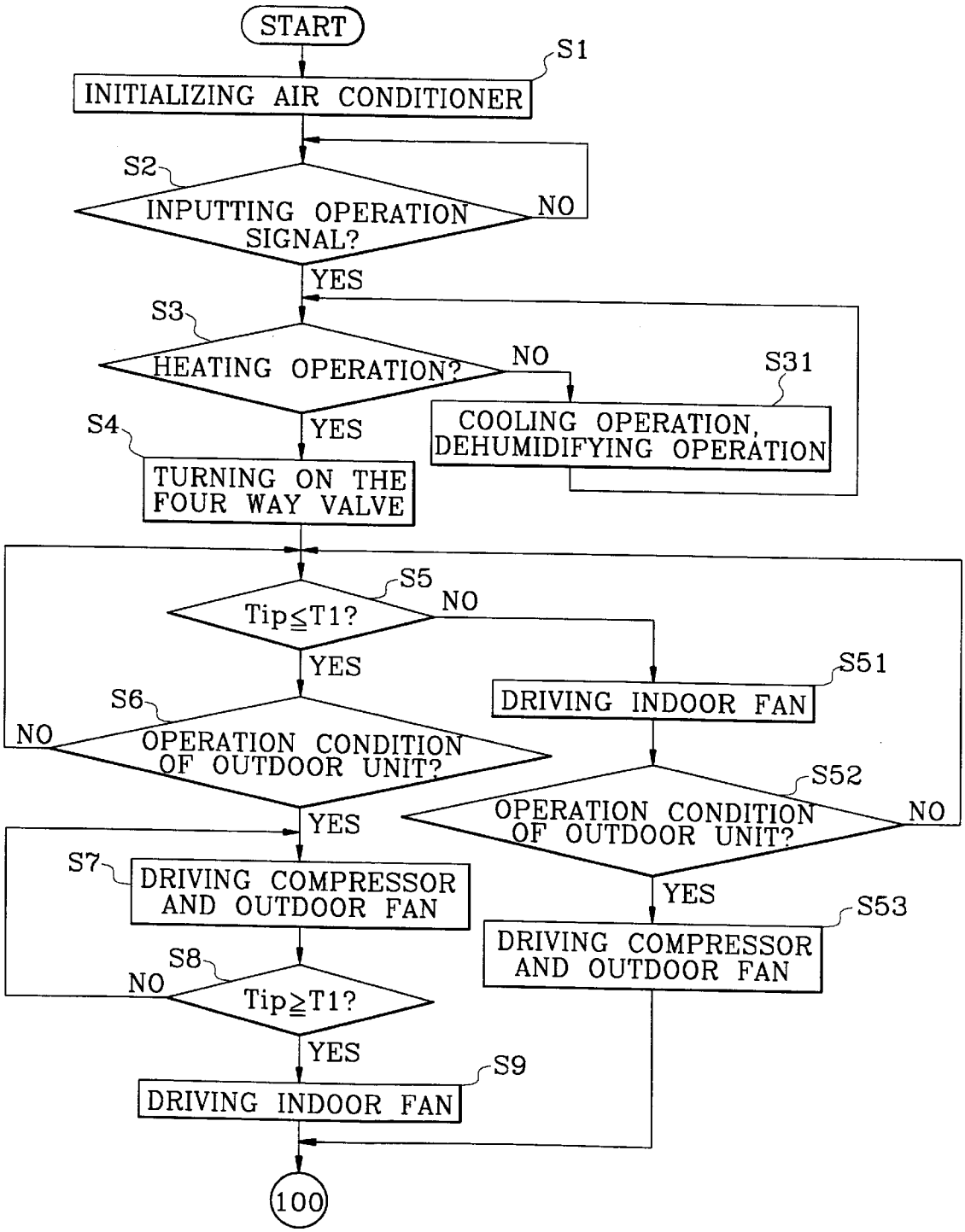
FIGS. 5*a,* and 5*b* are flowcharts for illustrating the defrosting operation of an air conditioner in accordance with the present invention.
Figure 5B:
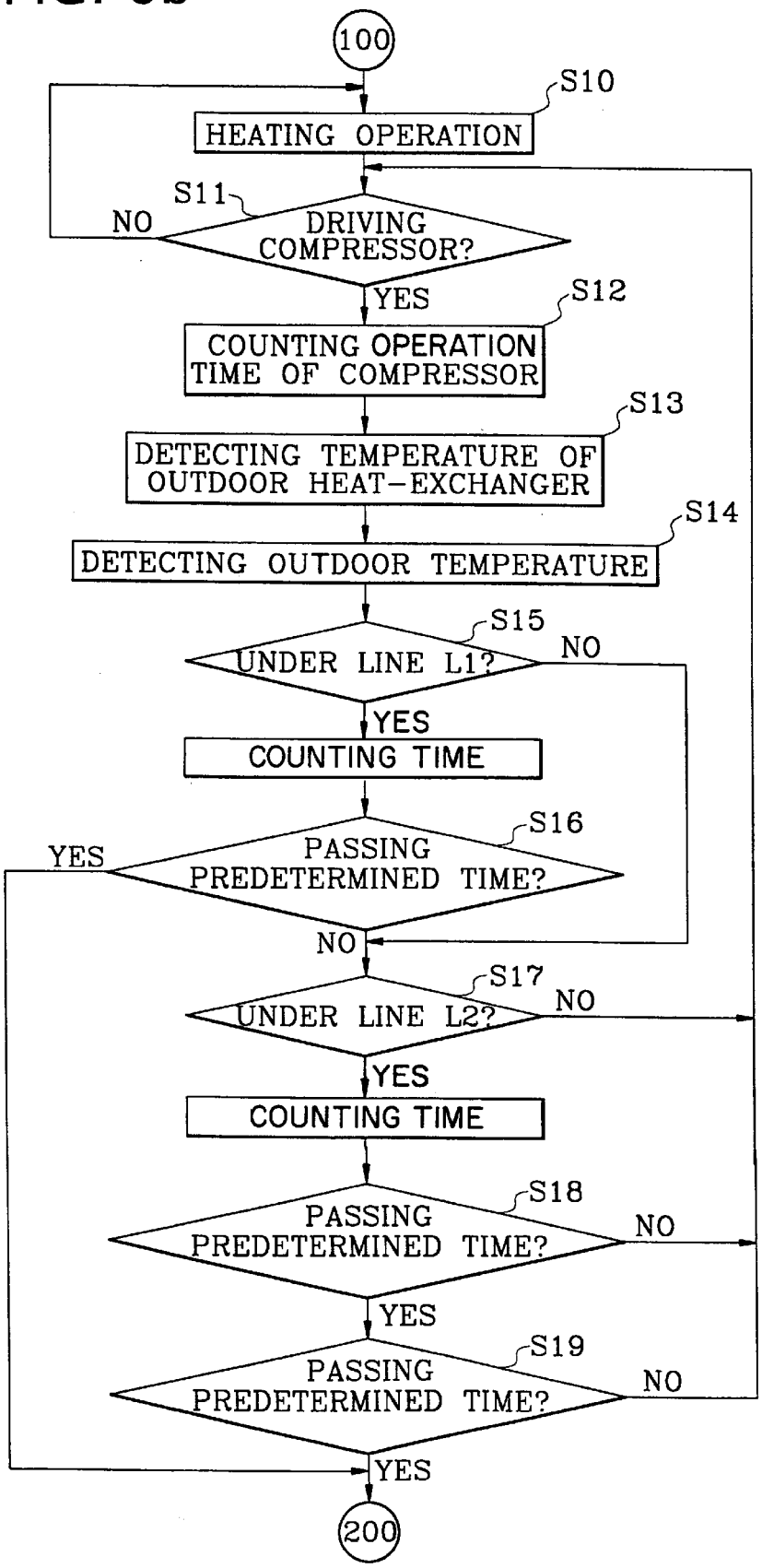
Figure 5C:
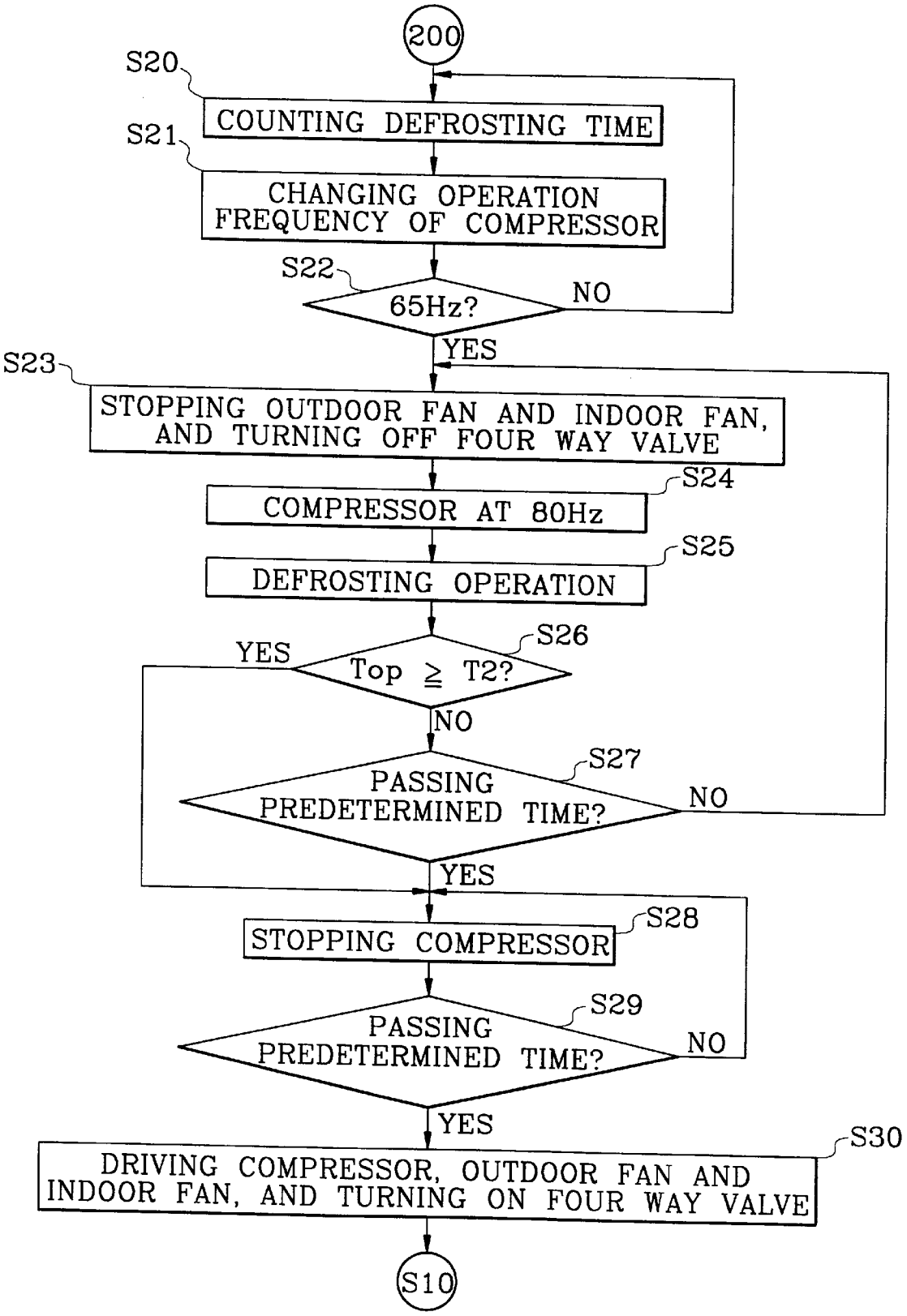

Hereinafter, a defrosting apparatus and the effect of its method are described. FIGS. 5*a* and 5*b* are flowcharts for illustrating operational procedures of the defrosting apparatus of an air conditioner in accordance with the present invention, wherein reference symbol S refers to its method steps.

First of all, when a power is applied to the air conditioner, the power source means(100) serves to convert the commercial alternating current voltage supplied from the alternating current power terminal into a predetermined direct current voltage necessary for driving the air conditioner and thereafter outputs same to respective driving circuit and controlling means(104).

At step S1, the direct current voltage output from the power source means(100) is received by the controlling means(104) to initialize the operation of the air conditioner. At this time, an user pushes an operation key with the operation manipulating means(102) to select an operation mode (for instance, heating) of the air conditioner, to set a temperature (Ts) as desired and to set an air amount, whereby an operation start signal and other operation selection signals (hereinafter referred to as operation signal) are sent to the controlling means(104).

At step S2, the controlling means(104) discriminates whether the operation signal is input from the operation manipulating means(102). If no operation signal is input to the controlling means(104) (in case of NO), repeated operations subsequent to step S2 are performed with the air conditioner being maintained at an operation stand-by state.

As a result of the discrimination at step S2, if the operation signal is input (in case of YES), flow advances to step S3, where the controlling means (104) to check whether the operation condition input by the operation manipulating means(102) is the heating operation. If no operation signal for the heating operation is input to the controlling means (104) (in case of NO), flow proceeds to step S31 for carrying out cooling or dehumidifying operation and repeated operations subsequent to S3 are performed.

As a result of the discrimination at step S3, if the operation is heating operation (in case of YES), flow proceeds to step S4, where the controlling means(104) sends a control signal for controlling the four way valve(31) to the four way valve driving means(128). Therefore, the four direction valve driving means(128) turns on the four direction valve(31) according to the control of the controlling means(104), whereby the coolant is circulated in the following direction: compressor(39)—four way valve(31)—indoor heat-exchanger(19)—expansion valve(33)—heating expansion valve(34)—outdoor heat-exchanger(35)—four way valve(31)—compressor(39).

At step S5, the indoor pipe temperature detecting means (110) detects the temperature (Tip) of the indoor heat-exchanger(19). At that time, the controlling means(104) receives analog data of the indoor pipe temperature (Tip) detected by the indoor pipe temperature means(110) to transform into digital information, to thereby discriminate whether the indoor pipe temperature is under the predetermined temperature (T1: about 27° C.: a preheating pipe temperature to prevent cool air from being discharged at the initial stage of the heating operation).

As a result of the discrimination at step S5, if the indoor pipe temperature (Tip) is under the predetermined temperature (T1) (in case of YES), the cool air can be discharged indoors. Therefore, the outdoor unit is firstly driven to heat the indoor heat-exchanger(19) without actuating the indoor fan(23). Then, flow advances to step S6, where the controlling means(104) discriminates whether the outdoor unit is at an operation condition. The operation condition of the outdoor unit means a case that the room temperature (Tr) detected by the room temperature detecting means(106) is lower than the temperature (Ts) set by the user.

As a result of the discrimination at step 6, if the outdoor unit is not at the operation condition, repeated operations subsequent to step S5 are performed. If the outdoor unit is at the operation condition (in case of YES), flow proceeds to step S7, where the controlling means(104) determines the operation frequency of the compressor(39) and the rotation number of the outdoor fan motor(125) according to the temperature difference of the room temperature (Tr) and the set temperature (Ts), and outputs control signals to drive the compressor(39) and the outdoor fan(37) respectively to the compressor driving means(122) and to the outdoor fan motor driving means(124).

Accordingly, the compressor driving means(122) drives the compressor(39) according to the operation frequency determined by the controlling means(104), and the outdoor fan motor driving means(124) drives the outdoor fan(37) according to the rotation number determined by the controlling means(104).

At step 8, the indoor pipe temperature detecting means (110) detects the temperature of the indoor heat-exchanger (19) heated during the circulation of the coolant by way of the operation of the compressor(39), and the controlling means(104) discriminates whether the indoor pipe temperature (Tip) detected by the indoor pipe detecting means(110) is over the predetermined temperature (T1). If the indoor pipe temperature (Tip) is not over the predetermined temperature (in case of NO), the cool air can be discharged indoors. Therefore, flow returns to S7 and repeated operations subsequent to step S7 are performed.

As a result of the discrimination at step S8, if the indoor pipe temperature (Tip) is over the predetermined temperature(T1) (in case of YES), cool air is not discharged indoors. Flow proceeds to step S9, where the controlling means(104) outputs a control signal to the indoor fan driving means(126) to drive the indoor fan(23). Therefore, the indoor fan motor driving means(126) drives the indoor fan(23) by controlling the rotation number of the indoor fan motor(21) according to the preset air amount.

As a result of the discrimination at step S5, if the indoor pipe temperature (Tip) is not under the predetermined temperature(T1) (in case of NO), cool air is not discharged indoors. Therefore, flow proceeds to step S51, where the controlling means(104) outputs a control signal to the indoor fan motor driving means(126) to drive the indoor fan(23). Therefore, the indoor fan motor driving means(126) drives the indoor fan(23) by controlling the rotation number of the indoor fan motor(21) according to the preset air amount. At step S52, the controlling means(104) discriminates whether the outdoor unit is at an operation condition.

As a result of the discrimination at step S52, if the outdoor unit is not at the operation condition (in case if NO), flow returns to step S5 and repeats operations subsequent to step S5 are performed with the air conditioner being maintained at an operation stand-by state. If the outdoor unit is at the operation condition (in case of YES), flow proceeds to step S53, where the controlling means(104) determines an operation frequency of the compressor(39) and a rotation number of the outdoor fan motor(125) according to the temperature difference of the room temperature (Tr) and the set temperature (Ts), to thereby output control signals to drive the compressor(39) and the outdoor fan(37) respectively to the compressor driving means(122) and the outdoor fan motor driving means(124).

Accordingly, the compressor driving means(122) drives the compressor(39) according to the operation frequency determined by the controlling means(104) and the outdoor fan motor driving means(124) drives the outdoor fan(37) according to the rotation number determined by the controlling means(104). Then, flow proceeds to step S10.

After the indoor fan(23), outdoor fan(37), and compressor (39) are in operation, at step S10, the coolant compressed into a gas of high temperature and high pressure by the compressor(39) is infused into the indoor heat-exchanger (19) through the four way valve(31), and the indoor heat-exchanger(19) heat-exchanges the compressed gaseous coolant of high temperature and high pressure into the air to be blown by the indoor fan(23). As a result, the room air sucked through the suction inlets(3) is heat-exchanged into warm air while passing through the indoor heat-exchanger (19).

The warm air heat-exchanged at the indoor heat-exchanger(19) moves upwards to heat the room controlling the air directions according to the angles of the vertical and horizontal vanes swingably coupled at the discharge outlets (7). At that time, the liquid coolant of low temperature and low pressure passes through the expansion valve(33) and the heating expansion valve(34) to get expanded to the evaporative pressure thereof, whereby the pressure of the coolant is then reduced to the gaseous coolant of low temperature and low pressure to be infused into the outdoor heat-exchanger(35).

Figure 3:
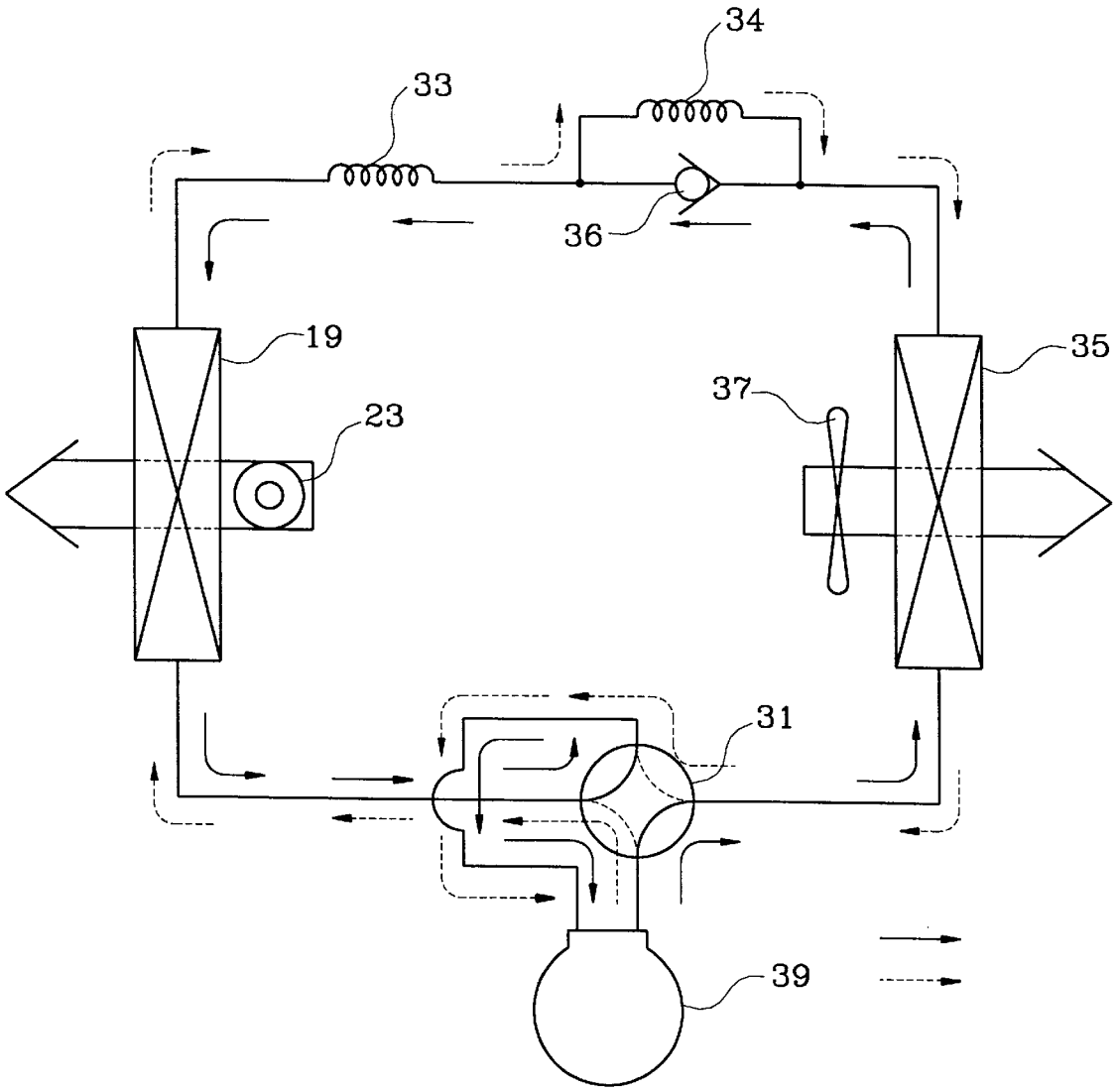
FIG. 3 is a circuit diagram for illustrating heating and cooling circulation routes in a conventional air conditioner.

The outdoor heat-exchanger(35) receives and heat-exchanges the gaseous coolant of the low temperature and low pressure with the air blown by the outdoor fan(37) via the evaporative latent heat of the coolant for cooling. The gaseous coolant of low temperature and low pressure cooled at the outdoor heat-exchanger(35) is again sucked through the four way valve(31) into the compressor(39) to be circulated in the repetitive heating cycle shown in the dotted line in FIG. 3.

If the heating operation is carried out for a sufficient period of time, the air blown by the outdoor fan(37) is heat-exchanged and cooled at the outdoor heat-exchanger (35) by the evaporative latent heat of the coolant, wherein the cool air causes frost to be accumulated on the surface of the outdoor heat-exchanger(35). The accumulated frost is turned into thick ice causing ice formation phenomenon as time passes.

In order to detect the accumulation of the frost on the outdoor unit, the defrosting condition is determined by comparing the temperature of the outdoor heat-exchanger (35) (Top), the outdoor temperature (To), and the operation time of the compressor(39). Therefore, the operation state of the compressor(39) is discriminated at step S11. If the compressor is not in operation (in case of NO), flow returns to step S10 and repeated operation subsequent to step S10 are performed.

As a result of the discrimination of step S11, if the compressor (39) is in operation(in case of YES). Flow advances to step S12, where the controlling means(104) starts to count the operation time of the compressor(39) by using the timer imbedded inside. Flow proceeds to step S13, where the temperature of the outdoor heat-exchanger(35) (Top) is detected by the outdoor pipe temperature detecting means(116). At step S14, the temperature of the outdoor air (To) is detected by the outdoor temperature detecting means (112).

Figure 6:
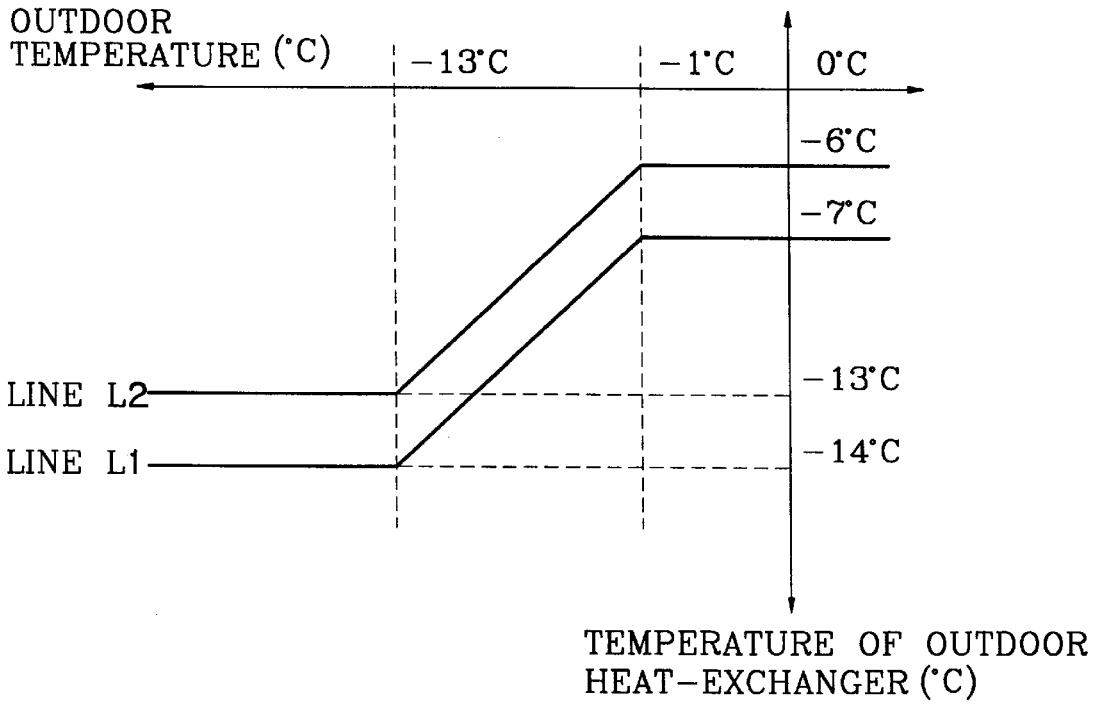
FIG. 6 is a defrosting detecting graph at the temperature of the outdoor heat-exchanger compared with the outdoor temperature in accordance with the present invention.

Therefore, at step S15, it is discriminated whether the outdoor pipe temperature (Top) of the outdoor heat-exchanger(35) is under the line L1 in FIG. 6 (for example, if the outdoor pipe temperature is under −14° C. at the outdoor temperature of −13° C., or if the outdoor pipe temperature is under −7° C. at the outdoor temperature of −1° C.). If the result of the discrimination at step S15 is under the line L1 (in case of YES), flow advances to step S16, where it is discriminated whether the predetermined time (tl: the time when frost started to be accumulated on the outdoor unit, about 20 minutes) at the temperature under the line L1 has passed.

As the result of the discrimination of the step S16, if the predetermined time (tl) wherein the temperature top is under the line L1 has not passed (in case of NO), flow proceeds to step S17, where it is discriminated whether the outdoor pipe temperature (Top) is under the line L2 in FIG. 6 (for instance, if the outdoor pipe temperature is under −13° C. at the outdoor temperature of −13° C., or the outdoor pipe temperature is under −6° C. at the outdoor temperature of −1° C.).

As a result of the discrimination of step S17, if the result of the discrimination at step S17 is not under the line L2 (in case of NO), flow returns to step S11 and repeated operations subsequent to step S11 are performed. If the result of the discrimination at step S17 is under the line L2 (in case of YES), flow proceeds to step S18, where it is discriminated whether the predetermined time (t2: about 20 minutes) at the temperature of under the line L2 has passed.

As a result of the discrimination of step S18, if the predetermined time (t2) (in case of NO), Therefore, flow returns to step S11 and repeated operations subsequent to step S11 are performed. If the predetermined time (t2) has passed (in case of YES), flow advances to step S19, where it is discriminated whether the operation time of the compressor(39) counted by the controlling means (104) is over the predetermined time (t3: about 35 minutes).

As a result of step S19, if the predetermined time (t3) has not passed (in case of NO), flow returns to step S11 and repeated operations subsequent to step S11 are performed. If the result of step S19 shows that the time has passed the predetermined time (t3) (in case of YES), it is determined that a frosting condition has accumulated on the outdoor unit. Therefore, in order to carry out the defrosting operation of the air conditioner, flow advances to step S20, where the controlling means(104) starts to count the defrosting time. Flow advances to step S21, where the operation frequency of the compressor (39) is changed into 65 Hz.

At step S22, it is discriminated whether the operation frequency of the compressor(39) is changed into 65 Hz. If the operation frequency of the compressor(39) is not changed into 65 Hz (in case of NO), flow returns to step S20 and repeated operations subsequent to step S20 are performed. If the operation frequency of the compressor(39) is changed into 65 HZ (in case of YES), flow advances to step S23, where the controlling means(104) outputs a control signal to the outdoor motor driving means(124) and the indoor motor driving means(126) to respectively stop the outdoor fan motor (125) and the indoor fan motor(21). At the same time, the controlling means(104) sends a control signal to the four way valve driving means(128) to control the four way valve(31).

According to the control signals from the controlling means, the outdoor fan motor driving means(124) stops the outdoor fan motor(125), the indoor fan motor driving means (126) stops the indoor fan(23), and the four way valve driving means(128) turns off the four way valve(31) to thereby change the flow of the coolant into a cooling cycle.

At step S24, the operation frequency of the compressor (39) is changed into 80 Hz in response to the defrosting operation. At step S25, if the four way valve is turned off, the flow of the coolant proceeds for the cooling cycle as follows: compressor(39)—four way valve(31)—outdoor heat-exchanger(35)—one way valve(36)—expansion valve (33)—indoor heat-exchanger(19)—four way valve(31)—compressor(39). The outdoor heat-exchanger(35) starts to get heated to carry out the defrosting operation at which the frost accumulated on the outdoor heat-exchanger(35) is removed.

If the defrosting operation is carried out for a predetermined period of time, the frost accumulated on the outdoor heat-exchanger(35) is removed. The completion of the defrosting operation is to be checked. Therefore, at step S26, the temperature (Top) change of the outdoor heat-exchanger (35) during the defrosting operation is to be checked by the outdoor pipe temperature detecting means(116) until the temperature (Top) of the outdoor heat-exchanger(35) is over a predetermined temperature (T2: the outdoor pipe temperature at which the frost accumulated on the outdoor unit is removed, about 12° C.).

If as a result of the discrimination of step S26, the outdoor pipe temperature (Top) has not passed the predetermined temperature (T2) (in case of NO), it is confirmed that the frost accumulated on the outdoor unit is not removed. Therefore, flow advances to step S27, where it is discriminated whether the defrosting time counted by the controlling means(104) has passed a predetermined time (t4: about 12 minutes).

As a result of the discrimination of step S27, if the defrosting time counted by the controlling means(104) has not passed the predetermined time(t4) (in case of NO), it is confirmed that the frost accumulated on the outdoor unit is not removed. Therefore, flow returns to step S23 and repeated operation subsequent to step S23 are performed. If the defrosting time counted by the controlling means(104) has passed the predetermined time (t4) (in case of YES), it is confirmed that the frost accumulated on the outdoor unit is removed. Therefore, flow proceeds to step S28, where the controlling means(104) outputs a control signal to the compressor driving means(122) to stop the compressor(39).

Accordingly, the compressor driving means(122) stops the operation of the compressor(39) according to the control of the controlling means(104). At step S29, the controlling means(104) checks whether the operation stopping time of the compressor(39) has passed the predetermined time (t5: about 30 seconds). If the operation stopping time of the compressor(39) has not passed the predetermined time(t5) (in case of NO), flow returns to step S28 and repeated operations subsequent to step S28 are performed.

As a result of the discrimination of step S30, if the operation stopping time of the compressor(39) has passed the predetermined time (t5) (in case of YES), flow proceeds to step S30, where the controlling means(104) sends control signals to the compressor driving means(122), the outdoor fan motor driving means(124), and the indoor fan motor driving means(126) to respectively drive the compressor (39), the outdoor fan motor(125) and the indoor fan motor (21) for the heating operation. At the same time the controlling means(104) outputs a control signal to the four way valve driving means(128) to control the four way valve(31).

According to the control signals from the controlling means, the compressor driving means(122) starts the operation of the compressor(39), the outdoor fan motor driving means(124) starts the outdoor fan motor(125), the indoor fan motor driving means(126) starts the indoor fan(23), and the four way valve driving means(128) turns on the four way valve(31) to thereby change the flow of the coolant into its heating cycle. At the same time, flow returns to step S10 and repeated operations subsequent to step S10 are performed.

On the other hand, as the result of the discrimination of the step S15, if the temperature top is not under the line L1

(in case of NO), flow proceeds to step S17 and repeated operations subsequent to step S17 are performed. As a result of the discrimination of step S26, if the outdoor pipe temperature (Top) is over the predetermined temperature (T2) (in case of YES), it is confirmed that the frost accumulated on the outdoor unit is removed. Flow advances to step S28 and repeated operations subsequent to step S28 are performed.

As described above, there is an effect of the defrosting apparatus in the air conditioner in accordance with the present invention in that the efficiency of the heating operation is substantially improved as the accumulation of the frost on the outdoor unit is correctly discriminated by comparing the temperature of the outdoor heat-exchanger, the outdoor temperature and the operation time of the compressor during the heating operation, and as the defrosting operation is carried out only if the frost has accumulated.

What is claimed is:

1. A defrosting method for removing frost accumulated on an outdoor heat-exchanger of an air conditioner having dual functions of cooling and heating, the method comprising the steps of:

A) presetting in a controller a first variable reference temperature which varies according to changes in outdoor temperature;

B) setting in the controller a second variable reference temperature which varies according to changes in the outdoor temperature, the second reference temperature being lower than the first reference temperature;

C) initiating a heating operation;

D) detecting a temperature of the outdoor heat-exchanger during the heating operation;

E) detecting an outdoor temperature during the heating operation, and varying the first and second reference temperatures according to changes in the detected outdoor temperature; and F) performing a defrosting of the outdoor heat-exchanger by changing the heating operation to a cooling operation if the detected temperature of the outdoor heat exchanger is below the first reference temperature for a first time period, or if the detected temperature of the outdoor heat-exchanger is below the second reference temperature for a second time period shorter than the first time period.

2. The method according to claim 1 wherein the outdoor heat-exchanger is fluidly connected to a compressor, wherein the defrosting of the outdoor heat-exchanger when the detected temperature thereof is below the first reference temperature for a first time period is performed only if the compressor has been operating for at least a third time period greater than the first time period.

3. The method according to claim 1 wherein the outdoor heat-exchanger is fluidly connected to a compressor, the outdoor heat exchanger including an outdoor fan, the performing of a defrosting of the outdoor heat exchanger in step F including stopping the outdoor fan and changing an operation frequency of the compressor.

4. The method according to claim 1 wherein each of the first and second variable reference temperatures preset in steps A and B is at a constant first value for a first range of outdoor temperatures, and is at a constant second value, less than the first value, for a second range of outdoor temperatures less than the first range.

5. The method according to claim 1 further including the step of stopping the defrosting of the outdoor heat-exchanger when the detected temperature thereof exceeds a third reference temperature.

6. The method according to claim 5 further including the step of stopping the defrosting of the outdoor heat exchanger when a predetermined time period beyond the additional predetermined time period expires, regardless of whether the detected temperature of the outdoor heat exchanger exceeds the third reference temperature.

7. A defrosting apparatus for removing frost accumulated on an outdoor heat-exchanger of an air conditioner which has a compressor, an indoor heat-exchanger, an outdoor heat-exchanger, an outdoor fan, an indoor fan, a four-way valve and a controller, wherein the apparatus comprises:

presetting means for presetting in the controller a first variable reference temperature which varies according to changes in outdoor temperature, and a second variable reference temperature which varies according to changes in the outdoor temperature, the second reference temperature being lower than the first reference temperature;

a time counter;

an outdoor heat-exchanger temperature detecting unit for detecting a temperature of the outdoor heat-exchanger during a heating operation; and an outdoor temperature detecting unit for detecting an outdoor temperature during the heating operation;

the controller connected to both the outdoor heat-exchanger temperature detecting unit and the outdoor temperature detecting unit for varying the first and second reference temperatures in accordance with changes in detected outdoor temperature;

the controller connected to the four-way valve and the compressor for performing a defrosting operation by changing the heating operation to a cooling operation if the detected temperature of the heat-exchanger is below the first reference temperature for a first time period, or if the detected temperature of the outdoor heat-exchanger is below the second reference temperature for a second time period shorter than the first time period.

8. The apparatus according to claim 7, wherein the outdoor heat-exchanger includes an outdoor fan; the controlling unit being operable to stop operation of the outdoor fan and change an operation frequency of the compressor during a defrosting of the outdoor heat-exchanger.

9. The apparatus according to claim 7 wherein the controlling unit is operable to stop the defrosting of the outdoor heat-exchanger in response to the detected temperature thereof exceeding a third reference temperature.

10. The apparatus according to claim 9 wherein the controlling unit is operable to stop the defrosting of the outdoor heat exchanger, in response to the expiration of a predetermined time period regardless of whether the detected temperature of the outdoor heat-exchanger exceeds the third reference temperature.

* * * * *